United States Patent [19]

Moore

[11] 4,084,363

[45] Apr. 18, 1978

[54] LIGHT-WEIGHT, INSULATED, CAN-COMPRISING CONSTRUCTION MEMBER

[76] Inventor: Alvin Edward Moore, Manini Way, Diamondhead, Bay St, Louis, Miss. 39530

[21] Appl. No.: 820,606

[22] Filed: Aug. 1, 1977

Related U.S. Application Data

[63] Continuation of Ser. No. 714,613, Aug. 16, 1976, abandoned, which is a continuation-in-part of Ser. No. 543,661, Jan. 24, 1975, Pat. No. 3,979,870, which is a continuation-in-part of Ser. No. 359,800, May 14, 1973, Pat. No. 3,878,661, which is a continuation of Ser. No. 102,317, Dec. 29, 1970, abandoned.

[51] Int. Cl.[2] ..... E04B 1/00; E04B 1/74

[52] U.S. Cl. ..... 52/309.4; 52/251; 52/404; 52/DIG. 9

[58] Field of Search ..... 52/309.4, 404, 91, DIG. 9, 52/576, 577, 726, 406, 127, 741, 443, 382, 251

[56] References Cited

U.S. PATENT DOCUMENTS

| | | | |
|---|---|---|---|
| 1,477,520 | 12/1923 | Pittman | 52/576 |
| 1,671,462 | 5/1928 | Bemis | 52/91 X |
| 2,497,053 | 2/1950 | Reid | 52/577 |
| 3,328,932 | 7/1967 | Cheskin | 52/576 X |
| 3,388,512 | 6/1968 | Newman | 52/127 X |
| 3,857,215 | 12/1974 | Moore | 52/577 X |
| 3,878,661 | 4/1975 | Moore | 52/443 |
| 3,944,008 | 3/1976 | Moore | 52/DIG. 9 X |
| 3,982,362 | 9/1976 | Moore | 52/DIG. 9X |

*Primary Examiner*—Price C. Faw, Jr.
*Assistant Examiner*—Robert C. Farber

[57] ABSTRACT

A bundle of three or more rows of end-joined cans (preferably in multiples of two rows) arranged around an axis of the group, clamped into a unit by flexible ties, such as: loops of adhesive strapping tape: apertured strips or tapes of thin metal, cloth or plastic, with tape ends fastened together by adhesive on the tape, or bolts, rivets or the like thru tape-end or network apertures, or snap fasteners with a stud on one end of each cloth or plastic tape loop and a crown on the other: loops of card with bands: or the like. This bundle may be used on the tubular framework of a wall, ceiling or roof of a stationary building, mobile home, trailer or vehicle, the framework preferably stuccoed on one side and stuccoed, plastered or otherwise wall-finished on the other. Optionally (and preferably when used as a ceiling or roof member), the bundle includes a middle core or V-shaped strip of concrete, mortar or other plastic material, poured downward into a middle channel between vertically-placed can rows or into V-shaped access between outer can-sidewall portions of two horizontally placed can rows. The bundle may be mold-sheathed in a matrix of plastic material (for example: porous concrete comprising portland or mortar cement and light-weight, porous aggregate: or formed residue plastic: or epoxy, asphalt or other adhesive mixed with fine porous aggregate such as verciculite. The matrix may be in the form of a building bar, panel, block or well-corner member. The cans preferably are used, each with an opening at a can-row joint that is contiguous with the end of an adjacent can. These joints and the imperforate can-end plate at each end of each can row prevent entry of fluent molding material into the rows. Preferably, adjacent ends of the cans of each row are fastened together (e.g., by: adhesive, solder or the like between the ends: adhesive tape around abutting can ends: wire glued or soldered to sides of the cans: or strips of wire or other network glued or soldered to portions of can sidewalls. Optionally, the can row may include pairs of adjacent cans of different diameter, the end of a can of smaller diameter fitting in a recessed can-end cap of a larger can. For bundle strength, preferably, the can-row joint at one end and a shorter can at the other end, with each row-end longer can in a bundle or an even number of rows being between two of the shorter cans. The invention includes a method of making a construction member and wall.

29 Claims, 12 Drawing Figures

FIG. 1
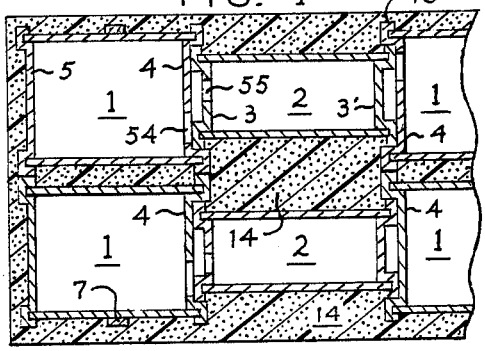
FIG. 4
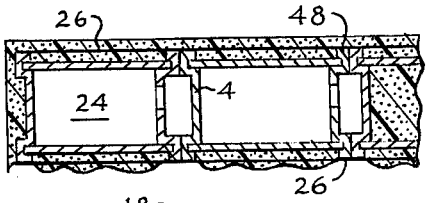
FIG. 5
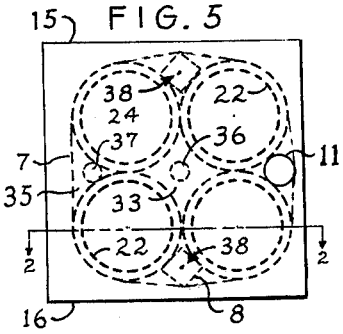
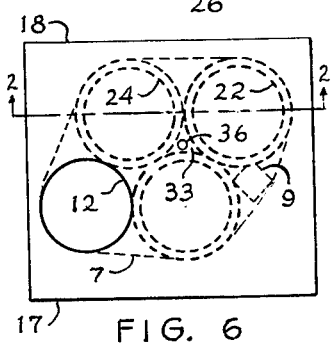
FIG. 6
FIG. 2
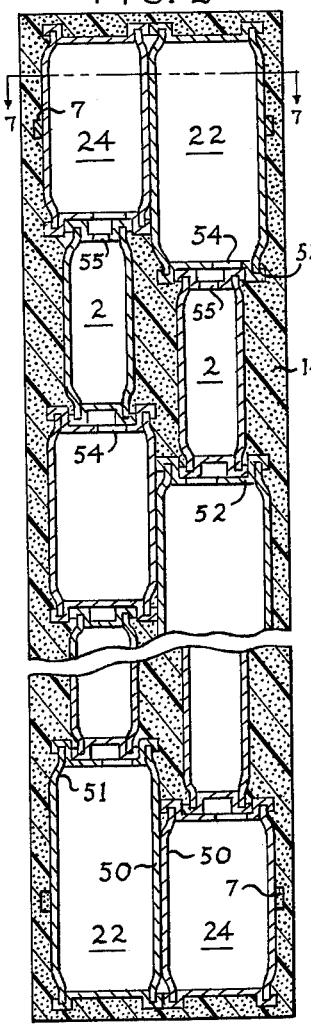
FIG. 3
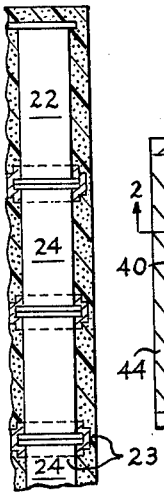
FIG. 7
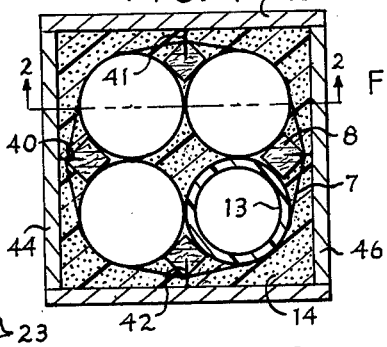
FIG. 8
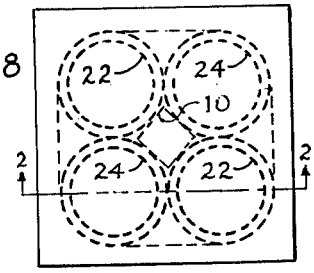
FIG. 9
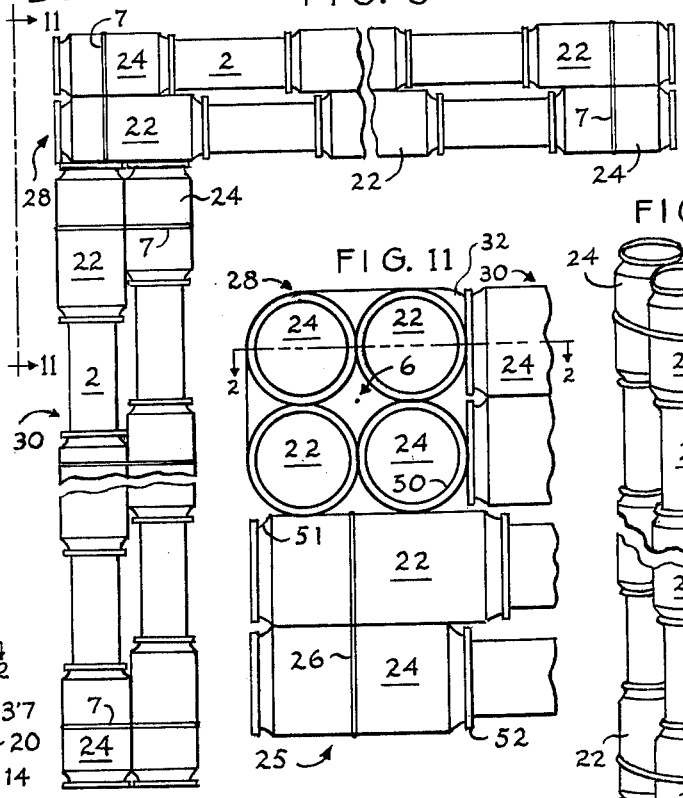
FIG. 10
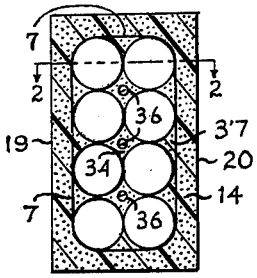
FIG. 11
FIG. 12
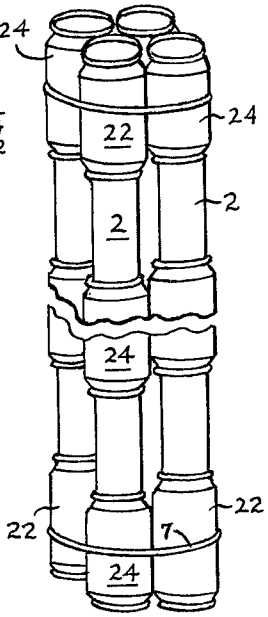

LIGHT-WEIGHT, INSULATED, CAN-COMPRISING CONSTRUCTION MEMBER

This invention pertains to a light-weight, insulated construction member and a method of making it. The present application is a continuation of application Ser. No. 714,613, filed on Aug. 16, 1976, now abandoned; and application Ser. No. 714,613 was a continuation-in part of application Ser. No. 543,661, filed on Jan. 24, 1975, now U.S. Pat. No. 3,979,870 which was a continuation-in-part of application Ser. No. 359,800 (U.S. Pat. No. 3,878,661), filed on May 14, 1973, which was a continuation of application Ser. No. 102,317, filed on Dec. 29, 1970, now abandoned. Except for the addition of the element 7, present FIG. 1 is a copy of FIG. 9 of each of applications Ser. Nos. 359,800 and 102,317 and of FIG. 10 of application Ser. No. 543,661; and FIG. 4 is closely similar to FIG. 7 of each of applications Ser. Nos. 359,800 and 102,317 and FIG. 8 of application Ser. No. 543,661, but is slightly changed in the improvement of this continuation-in-part application. Claims to these figures have been divided from the said prior applications because of the need to restrict them in the absence of allowed generic claims.

There has long been a need in construction of houses, mobile homes, lawn buildings, trailers, boats and other vehicles of a thermally insulating construction bar, block or panel light enough in weight to be easily handled in building operations, yet strong enough for a strength-providing wall, and conforming generally to exterior and interior lines of the house or other construction. Another long-existent need is a solution of the waste and disposal problem of used cans.

In view of these facts, some objects of the present invention are to provide: (1) a construction member of cans, new or used but preferably used, joined and fastened together in end-to-end relation in three or more parallel can rows that are grouped around a middle line of the member and connected in a bundle that serves either as a core of a light-weight matrix of foamed plastic, porous concrete or other plastic material or as a construction element built into a wall for later stuccoing or plastering; (2) such a bundle of can rows, sheathed in a plastic matrix which has opposite planar surfaces that substantially conform to desired wall, ceiling or roof faces; (3) a member as in (1) or (2) above, in which six or more rows of end-joined cans are fastened together in a panel-forming bundle, the axes of these rows being grouped around an interior line of the member; (4) the member of (1), (2) or (3) above, in which the cans are grouped in three or more rows, each row having bundle-strengthening joints between can ends, each joint being formed by: an end plate of a can having a relatively large cross-sectional area, this plate having a recess in it; and an end of a can of relatively smaller cross-sectional area that fits in the recess. These and other objects of the invention are indicated in the following specification and the attached drawings.

In these drawings:

FIG. 1 is a fragmentary view of a member of the invention, in section from a plane that contains the can axes of two of the can rows and may be considered as indicated by the arrowed lines 2—2 of FIGS. 5, 6, 7, 8, 10 or 11;

FIG. 2, partly broken away, is a sectional view of another form of the invented member which also may be considered as from the plane 2—2 of FIGS. 5, 6, 7, 8, 10 or 11;

FIG. 3, on a reduced scale and partly broken away, is a fragmentary view of the invented member, showing a third form of the invention, having cans of equal cross-sectional area and unequal lengths, in section from a plane which may be considered as indicated by the lines 2—2 of FIGS. 5, 6, 7, 8, 10 or 11;

FIG. 4 is a reduced-scale, fragmentary, sectional view, optionally from the plane 2—2 of FIGS. 5, 6, 7, 8, 10 or 11, indicating an optional type of means for fastening the cans of a row together;

FIG. 5 is an end view, in plan or elevation, of a bundle of four of the can rows, means holding them in assembled relation and a plastic-material matrix for the cans;

FIG. 6 is a similar end view of a similar member having three can rows;

FIG. 7 is a view in cross section thru a hinged mold in which a member comprising three rows and a pipe is shown before removing them from the mold;

FIG. 8 is an end view of a member having four can rows and a central can-bracing element.

FIG. 9 is a plan view of a wall corner comprising can-row bundles, this member optionally being usable for installation in a construction for later stuccoing or for sheathing in a plastic-material matrix;

FIG. 10 is a reduced-scale, sectional view of an optional bar, block or panel comprising eight of the can rows;

FIG. 11 is an elevational view of the wall corner of FIG. 9 from the plane indicated by the arrowed line 11—11 of FIG. 9; and FIG. 12 is an isometric view, partly broken away, of an elongated member of the invention, comprising four can rows.

Each of the disclosed construction members may comprise a bundle of rows of end-joined cans, tied together for laying or vertically placing in a wall, ceiling or roof, with joints of mortar, concrete or adhesive between adjacent bundles and for later exterior stuccoing and interior-surface finishing of the wall, ceiling or roof. But preferably the bundle is placed in a mold, and a matrix of plastic material is poured or injected around the bundle as a core. This shape-holding plastic material may be foamed resinous plastic, dense resinous plastic or wet, easily poured or injected concrete. The foamed plastic optionally may be foamed concrete, optionally having light-weight aggregate, but preferably it comprises any known type of mold-placed resin with a foaming and hardening agent. For example, it may comprise the two polyurethane liquids, known to persons skilled in the plastics art, which are mixed and poured or injected into a mold, where it briefly and foamingly expands and then sets into foamed polyurethane. When the plastic material used is calcareous concrete it preferably is porous and thermally insulating. It may comprise cement (portland cement, or lime, or mortar cement, or epoxy or other cement) mixed with light-weight fine aggregate, which may be cinders, expanded baked clay or shale, vermiculite, ground or shredded foamed plastic (for example shredded polyurethane foam), pumice, charred sawdust, ground charcoal, and/or ground coke. Any of these porous types of aggregate insures that the concrete comprising this aggregate is porous, light in weight and thermally insulating. The aggregate and cement are mixed with water in a concrete mixer or by hand before the porous materials are poured or injected into the mold.

The bar of panel of FIG. 1, considered with any of FIGS. 5 to 11, comprises a bundle of four (or, optionally, six or more) rows of end-joined cans in a molded matrix of plastic material. Optionally equal-diameter, end-joined cans of the general type shown in FIG. 3 or FIG. 4 may be substituted for the cans of FIG. 1. Each row comprises cans 1 of relatively larger cross-sectional area and cans 2 of smaller cross-sectional area. Each can 2 has its opposite ends 3 and 3' nested and preferably bonded in recessed end plates 4 of adjacent larger cans 1. The end plates 3' and the other end plates 5 of the larger cans are imperforate. Such an imperforate end plate is at each end of each can row, thus together with the can-row joints barring entry of molding material into the row when (as is currently preferable) the member includes a matrix of plastic material around the cans.

Preferably the can rows of the bundle, grouped around an interior line 6 (FIG. 11) of the member, are held together by one or more ties 7, and optionally also by elongated row bracing, rod-like elements 8, 9, 10, 11, 12, 13, 36 and/or 37. The elements 8, 9 and 10 are wooden or plastic sticks extending from one end of the bundle to the other; the element 11 is an electrical conduit or small water pipe that may be imbedded in some of the matrixes; and the numeral 12 or 13 indicates a drain pipe or the like which may be in some of the matrixes. The metal or plastic pipes (11 or 12) have their tops and bottoms temporarily covered over by adhesive-tape or removable caps to prevent entry of molding material into the pipes; and these pipes extend from the top to the bottom of the mold.

Optionally — and especially when the bundle, without the matrix, is utilized to build tubular framework of an upright wall or a ceiling or roof, to be later wall-finished — the group of can rows may be internally rod-reinforced only by the elongated elements 36, imbedded in plastic material, as described later in this specification. In this event, none of the optional elongated side reinforcements 8, 9 and 37 is utilized, and if the square type elongated element is used (instead of the round rod 36) it preferably is smaller in cross section than it is shown in FIG. 8 and sheathed in plastic material. Optionally, the tie elements 7 then also may be eliminated.

But, preferably, as indicated in FIG. 9, a tie element 7 is tautly placed around the bundle at each of its end portions. When a matrix is to be molded around the bundle of rows, these ties may be strong, preferably wide rubber bands — or, optionally, wires with twisted-together ends, or apertured strips (of plastic, hardware cloth or pipe strap) with bolts or rivets, snap fasteners or other rod-like elements closing ends of the strips, tautly clamping them around the cans — or adhesive tape (preferably of the strong type used in packaging). In any event, such rubber bands may be used optionally in addition to one or more other-type ties) to hold the bundle of rows together. When no matrix around the bundle is to be formed, for extra strength (with or without rubber-band ties) wires, strong cords, strips or loops of adhesive tape of the above type preferably are used — adhesive strapping tape being currently preferred.

In the form of the invention in FIG. 1, all the larger cans 1 may be of the same length, and may be, for example, 12-ounce, 14-ounce or 16-ounce beer cans; and the smaller cans 2 also may be of the same length and optionally may be 10-ounce beer cans. Twelve-ounce cans of the used type that have held *Coca Cola* or other soft drinks also may be utilized as the larger cans 1. The bonding material which preferably fastens the ends of the smaller cans 2 in the recessed end caps of the cans 1 optionally may be contact cement, epoxy putty or cement, liquid ruber that has set, silicone rubber of the general type used as bathtub seal, solder, brazing, or the like. Entire rings of this bonding material optionally may be placed between the rims of the cans 2 and the rims of the cans 1; but preferably only a few bits of it are used between each adjaent-pair of can ends, which suffice to hold the cans firmly together in the rows. This bundle of three, four or more can rows is shown as sheathed in a mold-formed matrix 14 which preferably has four planar sides, two opposite ones of these sides (15, 16 or 17, 18 or 19, 20) being adapted to conform to the exterior and interior faces of upright walls, ceilings or roofs of a constructed object. The other two sides may be mortared or glued to adjoining horizontal, sloping or vertical sides of adjacent bars or blocks; or if one of the bars or blocks is vertically placed at a wall corner only one of these opposite sides is bonded to an adjacent bar or block, the other side being unattached. After such assembly in a wall the sides of the member that are exposed to air are coated with a firm waterproof material — for example, stucco coated with STADRI or other paint, or else finished only with several coats of paint.

FIGS. 2, 9, 11 and 12, considered with FIGS. 3, 4, 5 to 8 and 10, illustrate the currently preferred form of the invention. Here the joints between can ends are staggered, so that when blows are received by a construction having a strength-providing, insulating framework of these bundles breakage is resisted by the assembled can rows, since any blow is opposite one or more can tubes as well as one or more joints that are staggered. Each row has a long can (22, for example a 14-ounce or 16-ounce beer can) at one end and a short can (24, for example a 12-ounce beer or soft-drink can) at its other end. In each end portion of a bundle of an even number of can rows (four, six or eight, for example) every long can 22 is flanked on each of its sides by a short can 24, and every short can 24 is between two of the longer cans 22. All the rows of each bundle are of equal length because each row of the bundle has the same number of long cans and the same number of short cans as every other row.

The cans of each row of FIG. 2 (or FIG. 1) optionally may have the same cross-sectional area and may be end-joined as in FIG. 3 or FIG. 4, each of these figures showing approximately half of the cross section along the plane 2—2 of FIGS. 5 to 8 or of FIG. 10. In FIG. 3 each joint between a pair of the cans comprises a can-end cap that abuts the adjacent end of another can and adhesive tape 23 that is tightly wrapped around the can-end rims. Alternatively, solder, epoxy putty, bathtub-seal type of silicone rubber cement, or other pasty adhesive may be substituted for the adhesive tape.

FIG. 4 illustrates an alternative means for fixing cans of equal cross-sectional area in an end-joined line. Each of the reinforcement elements 26 may be considered to be: a narrow strip of wire or plastic netting (for example of hardware cloth, poultry-fence wire or pipe strap); or a single wire or rod; or a strip of adhesive tape, preferably strapping tape. These reinforcement elements may be fixed to the sidewalls of the cans by epoxy glue, other pasty glue such as silicon rubber of the bathtub-seal type, solder or the like. When the element 26 comprises mesh or pipe strap the can-fastening portions of bonding material extend thru apertures and onto the cans.

FIG. 10 illustrates the construction of a relatively wide panel of the can rows. The bundle here is shown to comprise eight can rows, but ten, twelve or more of the rows may be thus assembled. Ties 7 tightly envelop the can rows at least at their end portions; and a matrix 14 of plastic material surrounds the rows.

FIGS. 9 and 11 illustrate a corner part of a wall made of bundles of four of the can rows, before stuccoing the bundles; or optionally the structure here shown may be the tubular framework of a corner construction member before a plastic-material matrix is mold-formed around the framework. This framework comprises: a lower bundle, 25, of four can rows of the staggered-joint type of FIGS. 2 and 5 to 8, this bundle being held together by the tie 26, which is similar to the ties 7; another lower bundle, not visible in FIGS. 9 and 11, back of and abutting the lower cans 22 and 24 (FIG. 11); an upper bundle, 28 (having the four upper staggered-length cans 24 and 22), this upper bundle bridging over the plane of division between the abutting two lower bundles; a second upper bundle 30 of four rows which abuts the bundle 28 and is fastened to 28 by epoxy putty or other adhesive or bonding material 32 — or alternatively by a short strip of pipe strap or metal network, fastened to the adjacent cans 22 and 24 by tapping screws and/or bonding material. When this structure is a corner part of the tubular framework of an upright wall, another set of abutting bundles, not shown in FIGS. 9 and 11, is placed in interlocking, corner-bracing fashion on the bundles 28 and 30; and other similar sets are superposed, to the top of the wall.

When the tubular framework of FIGS. 9 and 11 are to be sheathed in a corner matrix of plastic material the molded material and bundles may form an entire corner of the wall — for example, eight feet high — or it may comprise only the four bundles here shown. In any event, the tubular frame, with or without a molded matrix, may extend in angled directions toward window frames or door frames, or toward a door frame in one direction and a window frame in the other.

When the tubular structure of FIG. 12 (or of FIGS. 1, 2 or 10 without the matrix 14) is built into a tubular wall that is to be stuccoed, and optional method of fastening together bundles (which may be eight feet long) comprises the following steps: (A) on a concrete or other foundation at each of the desired corners of the wall, standing one of the bundles vertically, and pouring mortar, concrete containing porous light-weight aggregate, or other plastic material which sets into shape-holding substance down thru a middle or interior channel or channels of the bundle, this channel or plurality of channels being comparable to those indicated at 33 and 34 in FIG. 5 or FIG. 10, without the matrix material there shown, the mortar or other plastic material being on the foundation and, optionally, extending above it a distance no greater than the height of one of the shorter cans; (B) fastening wall plates (preferably of lumber) to tops of the upright corner bundles (this may be accomplished by bolts previously fastened in drilled holes in upper can-end caps and nuts — and/or by adhesive); (C) providing door frames and any necessary window frames, installing vertical bundles between said corner bundles and the frames, and installing upright, shorter bundles above each door frame and above and below window frames; (D) fastening network capable of holding stucco to outer portions of sidewalls of the cans of larger diameter by tapping screws extending into the material of the cans and/or by epoxy putty, other pasty adhesive or other bonding material; (E) fastening paneling (for example gypsum board, plywood or masonite) to inner portions of the sidewalls of the larger cans, by screws and/or pasty adhesive or other bonding material; (F) stuccoing the said network (by hand-troweling or spraying cement (for example, portland cement, mortar cement or epoxy) mixed with aggregate or filler; and (G) waterproofing the outer surface of the cement (for example, with several coats of STADRI or other paint).

When, as is preferred, the method of construction includes building a ceiling and roof over the wall formed by the above method, the following additional method steps may be taken: (H) fastening horizontal ceiling bundles to wall plates, each of these bundles being further strengthened by concrete, mortar, or other plastic material pooured downward into a middle channel of the type indicated at 33 and 34 or (when a bundle is horizontally lying on its side) poured into a V-shaped spaces of the type indicated at 35, this concrete or the like being placed around a metal concrete-reinforcement rod 36 (FIGS. 5 and 10), which thus is imbedded in the plastic material; (I) connecting the ceiling bundles by planks extending across the axes of the bundles, fastened to lower portions of the sidewalls of cans of larger diameter by screws or bolts in small holes drilled thru the planks and into can sidewalls and/or by epoxy putty or other pasty adhesive (alternatively, this step may comprise fastening network capable of holding stucco or plaster — for example, metal lath — to under portions of can sidewalls by tapping screws and/or bonding material, and stuccoing or plastering this network); (J) fastening slanting roof bundles of can rows (reinforced by rods 36 in concrete or the like) to end portions of the ceiling rows and to the wall plates by loops of pipe strap (or network of metal or strong plastic tape), one of the loops enveloping each roof bundle, and fastened to the said end portions by tapping screws extending from apertures of the loop into cans, and preferably also having its ends screw-fastened to the wall plates; (K) connecting the roof bundles by planks extending across the axes of these bundles, fastened to upper portions of roof cans by screws in small holes drilled thru the planks and into can sidewalls and/or by epoxy putty or other pasty adhesive (alternatively, this step may comprise fastening network capable of holding stucco — for example, metal lath — to upper portions of roof cans, and stuccoing this network); and (L) applying roofing material — for example, metal or asphalt roofing, nailed or screwed to the planks (or glued or otherwise fastened to the stucco when stucco is used on the roof); such roofing — preferably metal — optionally may be fastened to cans of larger diameter by tapping screws in small holes drilled thru the roofing and into can sidewalls and mounding epoxy or other pasty adhesive over the screw heads and holes.

When bundles of rows of cans of equal diameter are utilized without plastic-material matrixes in building a tubular framework such as that of FIGS. 9 and 11, and these can rows are not too long to be stood upright in the process of fastening them into the bundles, they preferably are internally reinforced only by the rods 36 and the plastic material around them. The rows, preferably of equal-diameter cans (which are optionally spot-glued or spot-soldered together), are stood vertically or at a steep incline in a rack-like fixture that temporarily and tightly holds the cans in assembled bundle relation; a slender rod or stick or piece of straight heavy wire 36, preferably of metal or molded strong plastic is placed in the internal cavity (33 or 34) and plastic material of the above-described type in its fluent state is poured or injected into the cavity until it is full. Preferably this plastic material has adhesive quality; it may be, for example, sand, cinders or vermiculite mixed with mortar cement (the lime of which adds adhesive quality to the mixture of portland cement and lime) or asphalt or shellac or contact cement or other liquid glue (optionally mixed with cinders, sand or vermiculite). Since the adhesive material spot-joins the rims of the cans together in each row it is unnecessary to preliminarily glue, solder or otherwise bind the can ends together - unless the additional strength of such bonding material or binding is desired. Also the two ties 7 may be eliminated; but preferably they are utilized. When bundles reinforced by the rods 36 as above described, without a matrix, are built into a tubular-wall framework each of rods 36 has a length equal to (or a little less than) the length of the can rows. But when the bundles are sheathed in matrixes of plastic mmaterials each of the rods 36 preferably has a length equal to that of the mold, and projects beyond the can rows a short distance from each end of the bundle, to center the can rows in the mold and prevent their floating upward during the pouring or injection of the fluent molding material. When the cans are of different diameters, aggregate large enough to lodge between smaller cans is mixed with the cement.

FIG. 7 illustrates a mold which may be used for forming a matrix around a bundle of four can rows. The same type of mold, rectangular in cross section, may be used to mold the matrix of a panel around six or more of the parallel can rows. The mold of FIG. 7 may be considered as vertically standing on its end or in horizontal position. When the bar, block or panel is so long with respect to the height of the factory ceiling that pouring or injecting the plastic materials into the mold from a location above it is not practical it is horizontally placed. But for all construction members not over eight feet long the mold is preferably upright and the plastic material is poured down into it thru the single channel or group of channels 33 or 34 and on all sides of the bundle of can rows. The hinged top of the mold (not visible in FIG. 7) preferably has at least three small nails or the like depending from it; and when the top is closed and held in place these rod-like elements bear against can-end caps, and hold the bundle tightly against similar nails or the like fastened to and projecting upward from the mold bottom. Thus its can rows are prevented from floating to the top of the liquid of the wet concrete or the foaming plastic. Alternatively, the wooden or molded-plastic or metal sticks 8, 9 or 10 which optionally are tightly clamped between can sidewalls (as in FIGS. 5 to 7) or in the channel or channels 33 or 34 between the assembled can rows (as in FIG. 8) may extend from the top to the bottom of the mold- or instead may have small nails or the like (38, FIG. 5) in their tops and bottoms, holding the bundles centered in the mold. When these nails or slender rod points are in the mold top and bottom they leave small holes in the matrix when the construction member is removed from the mold; when they are in the optional wooden sticks (or are integral points on metal or plastic rods they are nearly entirely covered by the plastic material of the matrix. Optionally, bundle-centering nails or the like (40, 41 and 42) may be placed in side portions of the sticks 8, 9 or 10 (when these are utilized); but the elements 40, 41 and 42 currently are not deemed to be necessary unless the mold is horizontally placed. In this case, the pair of nails or the like 41 (in end portions of the upper bundle-reinforcing stick) prevent the can rows from floating in the liquid-like plastic material; and the similar lower pair of nails or the like (42) aid in centering the bundle. The side nails 40 are optional, and may be eliminated.

The mold comprises at least two hinged sides and one hinged end; and when the mold is horizontally placed it preferably has: two sides (44 and 46) that are hinged to the mold bottom; a top (45) that is hinged (or else fixed) to the upper edge of one of the sides (44 or 46) and tightly clampable (for example, by a hook and eye) to the other of these sides; and two mold-end plates, at least one of which is hinged to the mold bottom plate and clampable at its upper edge (e.g., by a hook and eye) to the top 45. When the mold is vertical the same sides are thus hinged, and only one end is hinged and clampable to the mold top, the lower mold end not being hinged.

The cans used may be new, but preferably they are used, and of thin metal, with one end opened. Each of these opened ends is closed against an imperforate plate at a joint between can ends. The cans preferably are cylindrical and of thin metal, but optionally they may be of dense resinous plastic or of glass (jars, bottles or the like). Two types of thin-metal cans are currently made in three lengths and sold in extremely large numbers for use as beer or soft-drink cans. The older type, illustrated in FIGS. 1, 3 and 4, has cylindrical tubes and rims 48 that project outward from the cylinders. The other type of cans, shown in FIGS. 2, 9, 11 and 12, have sidewall portions 50 that are cylindrical, sidewall parts 51 that slope inward, and can-end caps 52 that project outward from the end portions of the sidewall sloping parts nearly to the cylinder extended of the portions 50. Therefore, these cylindrical portions 50 in a can row of the type of FIGS. 2, 9, 11 and 12 may be in contact.

Optionally, easily applied insulation may be put in the cans — for example, vermiculite, tufts of rockwool or fiberglass, little nodules of foamed resinous plastic, slightly charred or preservative-treated sawdust, ground bark or cork, or the like. When the cans are small, for instance, beer or soft-drink cans, such insulation is not preferred, for their small, closed volumes of air serve as insulation, with added insulation effect of the bright inside surfaces of the can metal. But when the cans are rather lage — e.g., coffee cans - or coffee cans with their opposite ends fitting in recesses of end caps of larger cans of the type that have contained tomato juice or fruit juice - they preferably have insulation in them.

When the cans utilized are used paint cans their friction-held lids are replaced, sealing the cans. When they are beer or soft-drink cans one end of each can has been opened as indicated in FIGS. 1, 2 and 4 at 54 and 55, and these openings are always at joints so that they are protected against entry thru them of the liquid-like plastic material. An imperforate end cap is at the end of each row, also barring entry of molding material into the row and adding to its thermally-insulating effect.

When the cans utilized are used cans of the type that have contained coffee one end cap of each can is mostly cut away, leaving only the can-end rim at this end. The large opening thus formed may be closed by the plastic cap that is sold with this can and its contained coffee.

But preferably the can-end rim at the opening of this can is glued or soldered to an imperforate can-end cap — which may be of another coffee can or when the opened can fits within the rim of a larger-diameter can — the abutting can ends are bonded together in the manner of FIG. 1 and FIG. 2.

Various modifications of the structure may be made. For examples: (1) the mold lid may be of sufficient weight to be closed against expansion of the foamed-plastic liquids, or in removing surplus wet concrete or forcing it to slightly indent can sidewalls; (2) the mold lid may not be hinged to side walls, but instead be vertically elevated or closed by a large screw that is fixed to the lid and turned by hand or a motor; and (3) the bundles, preferably reinforced by the concrete-sheathed rods 36, with or without matrixes, may be utilized as floor members — to form the floor of a transportable, factory-built house or vehicle or, bedded on foundation concrete, in the floor of a house built on a lot.

In the claims, unless otherwise qualified: the work "can" signifies a hollow article or receptacle having at least one end closure, of any material (for example of metal, glass or plastic); "plastic material" means any natural or synthetic plastic (including cement — portland, epoxy, aphalt, shellac, or the like — or firm resinous plastic, or foamed resinous plastic: "bonding material" signifies epoxy or other cement or glue, optionally including aggregate or filler, solder, brazing, welding, or the like; and "wall" means an upright wall, ceiling, floor or roof.

I claim:

1. A construction member, adapted for assembly with other elements of a composite structure, including:

a bundle comprising a plurality of at least three rows of end-joined cans, assembled around an interior line of the member, said line being within a cavity between and surrounded by sidewall portions of cans of said plurality of rows, the axes of said rows of cans being grouped thru three hundred and sixty degrees around said line; each of said cans having row-strengthening can ends, one of said ends being an imperforate can-end cap; each of said rows having a said imperforate can-end cap at each of its ends and including a plurality of row-strengthening joints between abutting pairs of can ends; each of said joints including: a can-end cap of one can of an adjacent pair of cans; a can end of the other of said pair of cans, abutting said last-named can-end cap; and connecting means fastening together said abutting can-end cap and can end; and tie elements surrounding said bundle, contacting can sidewalls of said rows of cans, holding said rows assembled in said bundle.

2. A construction member as set forth in claim 1, in which the said can rows comprise cans of different lengths and adjacent joints of juxtaposed rows are staggered, a relatively longer can being at one end of each can row, and a shorter can at the other end of the row; the said bundle comprising at one of its ends a said longer can that is juxtaposed to a said shorter can at the end of an adjacent can row.

3. A construction member as set forth in claim 2, in which the said bundle comprises an even number of said rows of cans, and at each end of the bundle: each of said longer cans is flanked by a pair of the shorter cans; and each of said shorter cans is flanked by a pair of said longer cans.

4. A construction member as set forth in claim 3, in which: the said cans of each row are of different cross-sectional areas; and each of the said joints comprise: a row-strengthening can-end plate of one of said cans of a relatively larger cross-sectional area, the said last-named plate having a recess in it; a can end of one of said cans of smaller cross-sectional area extending into said recess; and bonding material between said last-named plate and smaller-can end.

5. A construction member as set forth in claim 3, further including a matrix of plastic material, in which the said bundle is imbedded.

6. A construction member as set forth in claim 3, in which: the said cans of each row are of different cross-sectional areas; and each of the said joints includes: a row-strengthening can-end plate of one of said cans of relatively larger cross-sectional area, the said last-named plate having a recess in it; an abutting can end of one of said cans of smaller cross-sectional area extending into said recess; and bonding material between the said last-named row-strengthening can-end plate of a larger plate and the said abutting can end of a smaller can.

7. A construction member as set forth in claim 2, in which: the said cans of each row are of different cross-sectional areas; and each of the said joints includes: a row-strengthening can-end plate of one of said cans of relatively larger cross-sectional area, the said last-named plate having a recess in it; an abutting can end of one of said cans of smaller cross-sectional area extending into said recess; and the said construction member futher includes a matrix of plastic material of the type that is fluent when applied and sets into shape-holding material, in which the said bundle of can rows is imbedded.

8. A construction member as set forth in claim 7, in which each of said joints further includes bonding material between said last-named can-end plate and said abutting can end of a smaller can.

9. A costruction member as set forth in claim 8, in which said plastic material comprises foamed plastic.

10. A construction member as set forth in claim 8, in which: the said cans of each row are used cans of the beverage-containing type; each of the cans has a pair of can-end plates, one of which has an opening thru part of the plate; and each of said openings is at one of said joints, substantially preventing entry of said plastic material in its fluent state thru the opening and into hollow spaces of the row.

11. A construction member as set forth in claim 8, in which: the cans of each row are used cans; each of the larger cans has a pair of recessed can-end plates; each of the smaller cans is of the coffee-containing type and has an imperforate can-end cap at one of its ends and another can end that has a can-end rim and an opening within and substantially outlined by said rim; and each of the said joints comprises bonding material between a said rim and a said recessed end plate.

12. A construction member as set forth in claim 1, in which: the said cans of each row have equal cross-sectional areas; and the said connecting means in each row comprises an elongated, apertured, row-strengthining strip, in contact with cans of the row, and bonding material between said stri and portions of said cans.

13. A construction member as set forth in claim 1, in which the said cans of each row have equal cross-sectional areas; and the said connecting means of each joint comprises adhesive tape around the said abutting can-end cap and can end of said pair of cans.

14. A construction member as set forth in claim 1, further including a row-reinforcing rod-like element, juxtaposed to portions of said rows of cans, and plastic material on said rod and adjacent parts of said cans, imbedding said rod and holding it in location adjacent to said portions.

15. A construction member as set forth in claim 14, in which the said rod-like element comprises wood.

16. A construction member as set forth in claim 14, in which the said rod-like element is a rod of metal, and said plastic material is calcareous concrete.

17. A construction member as set forth in claim 1, joined to other construction members of the type of claim 1 in a wall corner, the said wall corner including: a said bundle as set forth in claim 1, laid horizontally along a wall line; a second said bundle at substantially the same level as said first-named bundle, horizontally laid along a second wall line at an angle to the first-named wall line, can-end plates at one end of said second bundle abutting side portions of cans at an end of said first-named bundle, at a plane of division between bundle ends; a third similar bundle on top of said second bundle and having sidewall portions of cans at one of its ends overlying said first-named side portions of cans and extending across said plane of division; a fourth, similar bundle at substantially the same level as said third bundle, horizontally laid above said first-named bundle, can-end plates at one end of said fourth bundle abutting side portions of cans at an end of said third bundle at a second plane of division betwee bundle ends; a third co-level pair of bundles having ends abutting at said first-named plane of division between bundle ends, and can sidewalls that extend across said second plane of division; and other, similar pairs of co-level bundles, each having ends abutting at one of said planes of division and sidewalls that lie over a said plane of division between said next lower pair of bundles, extending to the top of the desired wall.

18. A construction member as set forth in claim 1, joined to other construction members of the type of claim 1 in a wall-corner element, the said wall-corner element including: a said bundle as set forth in claim 1, laid horizontally along a line of a desired wall; a second said bundle at substantially the same level as said first-named bundle, horizontally laid along a second line of the desired wall that is at an angle to said first-named wall line, can-end plates at one end of said second bundle abutting side portions of cans at an end of said first-named bundle, at a plane of division between bundle ends; a third, similar bundle above said second bundle and having sidewall portions of cans at one of its ends extending across said plane of division between bundle ends and overlying said first-named side portions of cans; a fourth, similar bundle at substantially the same level as said third bundle, above said first-named bundle, can-end plates at one end of said fourth bundle abutting side portions of cans at an end of said third bundle and at a second plane of division between bundle ends; and a wall-corner matrix of plastic material on said bundles, in which they are imbedded.

19. A construction member, adapted for assembly with other elements of a composite structure, including:

a bundle comprising a plurality of at least three rows of end-joined cans, assembled thru three hundred and sixty degrees around an interior line of the member, said line being within a cavity between and surrounded by sidewall portions of cans of said plurality of rows; each of said cans having row-strengthening can ends, at least one of said ends being an imperforate can-end cap; each of said rows having a said imperforate can-end cap at each of the ends of the row and including a plurality of row-strengthening joints between abutting pairs of can-ends; each of said joints including a can-end cap of one can of an adjacent pair of cans and a can end of the other of said pair cans, abutting said last-named can-end cap; and means reinforcing said joints and holding said rows assembled in said bundle, comprising: a rod-like element within said cavity, having a length in the neighborhood of the length of said rows; and a core of plastic material of the type that is fluent when applied and sets into shape-holding material, contiguous to said portions of can sidewalls in said cavity, in which said rod-like element is imbedded.

20. A construction member as set forth in claim 19, in which: the said can rows of the bundle are of equal length and have said row-end imperforate can-end caps closely adjacent to each other and to the end of the bundle; each of said rows comprises cans of different lengths, a longer can in each row being flanked by at least one shorter can; and the said joints are staggered.

21. A construction member as set forth in claim 19, in which: a small portion of said rod-like element projects from each end of said bundled rows and from said cavity and core, having a length substantially equal to that of said construction member; and the said member further includes a matrix of plastic mterial of the type that is fluent when applied and sets into shape-holding material, the said bundle and rod-like element and core being imbedded in the said matrix.

22. A construction member as set forth in claim 19, further including tie elements, encompassing said can rows.

23. A method of making a wall, including the following steps:

(A) forming a plurality of bundles, each comprising at least four rows of cans, assembled around an interior line of the bundle, the said line being in a cavity between and surrounded by portions of sidewalls of said cans, by connecting together adjacent can ends of each row and binding the rows of the bundle with tie elements;

(B) at each of the desired corners of the wall, uprightly standing one of said bundles and pouring plastic material which sets into shape-holding substance into said cavity;

(C) fastening wall plates to tops of the upright corner bundles;

(D) providing door frames and any necessary window frames between pairs of said corners, installing upright bundles between said corner bundles and frames, and installing shorter bundles above each door frame and above and below each window frame;

(E) fastening network capable of holding stucco to outer portions of can sidewalls of said bundles;

(F) fastening wall-finishing material to inner portions of can sidewalls of said bundles; and (G) applying stucco to said network.

24. A method as set forth in claim 23, further including the following steps: (H) horizontally placing some of said bundles between a pair of said wall plates and fastening end portions of said last-named bundles to said pair of wall plates, forming a ceiling framework of horizontal bundles; (I) fastening some of said bundles at their end portions to said bundles of the ceiling framework, forming a roof framework of sloping bundles; and (J) forming ceiling-finishing surfaces on said ceiling framework and roof-finishing surfaces on said roof framework.

25. A construction member, including:

a bundle including a plurality of at least three rows of end-joined cans, assembled around an interior line of the member, said line being within a cavity between and surrounded by sidewall portions of cans of said plurality of rows, the axes of said rows of cans being grouped thru 360° around said line; each of said cans having row-strengthening can ends; each of said rows including a plurality of row-strengthening joints between abutting pairs of can ends; each of said joints including: a can-end element of one can of an adjacent, aligned pair of cans; a can-end element of the other of said pair of cans, abutting said first-named can-end element; and connecting means holding together said abutting can-end elements; and means, contacting cans of said rows, holding said rows assembled together.

26. A construction member as set forth in claim 25, in which the said can rows include cans different lengths and adjacent joints of juxtaposed rows that are staggered, a relatively longer can being alongside a shorter can at each of said staggered joints.

27. A construction member, including:

a bundle including a plurality of at least three rows of end-joined cans, assembled thru three hundred and sixty degrees around an interior line of the member, said line being within a cavity between and surrounded by sidewall portions of cans of said plurality of rows; each of said rows having row-strengthening can ends, and including a plurality of row-strengthening joints between abutting pairs of said can ends; each of said joints including a can-end element of one can of an adjacent, aligned pair of cans and a can-end element of the other of said pair of cans that abuts said first-named can-end element; and means reinforcing said joints and holding said rows assembled in said bundle, including: construction-member-reinforcing means in said cavity; and a core of plastic material of the type that is fluent when applied and sets into shape-holding material, contiguous to said portions of can sidewalls in said cavity, in which said reinforcing means is imbedded.

28. A construction member as set forth in claim 27, in which the said can rows include cans of different lengths and adjacent joints of juxtaposed rows that are staggered, a relatively longer can being alongside a shorter can at each of said staggered joints.

29. A construction member as set forth in claim 27, in which each of said rows includes: cans of different cross-sectional areas; and a plurality of said joints in each of which a can-end element of a smaller can abuts a can-end element of a larger can.

* * * * *